US006038419A

United States Patent [19]

Tokunaga

[11] Patent Number: 6,038,419

[45] Date of Patent: Mar. 14, 2000

[54] CONTACT CHARGING DEVICE HAVING A MAGNETIC BRUSH COMPRISED OF MAGNETIC PARTICLES FOR ELECTROSTATICALLY CHARGING A PHOTOSENSITIVE DRUM

[75] Inventor: Yuzo Tokunaga, Yokohama, Japan

[73] Assignee: Canon Kabushiki Kaisha, Tokyo, Japan

[21] Appl. No.: 09/138,400

[22] Filed: Aug. 24, 1998

[30] Foreign Application Priority Data

Aug. 26, 1997 [JP] Japan ..... 9-229289

[51] Int. Cl.[7] ..... G03G 15/00

[52] U.S. Cl. ..... 399/175; 399/174

[58] Field of Search ..... 399/168, 174, 399/175, 176; 361/225; 430/108, 111

[56] References Cited

U.S. PATENT DOCUMENTS 5,579,095 11/1996 Yano et al. ..... 399/175

5,799,233 8/1998 Ishii et al. ..... 399/175

FOREIGN PATENT DOCUMENTS 63-149669 6/1988 Japan .

6-3921 1/1994 Japan .

*Primary Examiner*—Quana Grainger

*Attorney, Agent, or Firm*—Fitzpatrick, Cella, Harper & Scinto

[57] ABSTRACT

A charging apparatus for an electrophotographic apparatus has a charging member provided with a magnetic brush of magnetic particles and an object member to be charged. The charging member is capable of electrostatically charging the object member upon application of a voltage. The magnetic particles are composed of a composite containing 80 to 98% by weight of a metal oxide and a thermosetting resin having been carbonized in part. Magnetic particles having a particle diameter ½ times or less the number-average particle diameter of the particles are contained in an amount of 30% or less by number.

28 Claims, 2 Drawing Sheets

CONTACT CHARGING DEVICE HAVING A MAGNETIC BRUSH COMPRISED OF MAGNETIC PARTICLES FOR ELECTROSTATICALLY CHARGING A PHOTOSENSITIVE DRUM

BACKGROUND OF THE INVENTION

1. Field of the Invention

This invention relates to an electrophotographic apparatus such as a copying machine and a printer, and a charging apparatus used therein. More particularly, it relates to a contact charging apparatus, and an electrophotographic apparatus, in which a charging member is brought into contact with a photosensitive member to electrostatically charge the photosensitive member.

2. Related Background Art

In charging apparatus used in electrophotography, corona charging assemblies have been conventionally used. In recent years, in place of them, contact charging assemblies are being put into practical use. The latter is intended for decreasing ozone and decreasing power consumption. In particular, roller charging systems employing a conductive roller as a charging member are preferably used in view of the stability in charging.

In the conventional contact charging, the charging is effected by the release of charges (discharging) from a charging member to an object member, and hence the charging takes place upon application of a voltage having a magnitude greater than a certain threshold voltage. For example, in an instance where a charging roller is brought into pressure contact with an OPC photosensitive member (a photosensitive member making use of an organic photoconductive material) of 25 $\mu$m in layer thickness, the surface potential of the photosensitive member begins to increase upon application of a voltage of about 640 V or higher, and thereafter the surface potential of the photosensitive member linearly increases by gradient 1 with respect to the applied voltage. Hereinafter, this threshold voltage is defined as charge starting voltage Vth.

More specifically, in order to obtain a required surface potential Vd of the photosensitive member, it is necessary to apply to the charging roller a DC voltage of Vd+Vth. The method in which only a DC. voltage is applied to a contact charging member to electrostatically charge the photosensitive member by discharging is called DC charging.

In the DC charging, however, it has been difficult to keep the surface potential of the photosensitive member at the desired value because the resistance value of the contact charging member may vary depending on environmental variations and also because the Vth may vary with changes in layer thickness due to the surface scrape of the photosensitive member with its use.

Accordingly, as a proposal to achieve more uniform charging, Japanese Patent Application Laid-Open No. 63-149669 discloses an AC charging system in which a voltage formed by superposing on a DC voltage corresponding to the desired Vd an AC voltage having a peak-to-peak voltage of 2×Vth or higher is applied to the contact charging member. This system aims at an effect of leveling the potential by AC voltage, where the potential of the photosensitive member is converged into the Vd that is the center of the peak of the AC. voltage and can be hardly affected by external factors such as environment.

However, even in such a contact charging apparatus, its essential charging mechanism utilizes the phenomenon of discharging from the charging member to the photosensitive member. Hence, as previously stated the voltage required for the charging is required to have a value greater than the surface potential of the photosensitive member and ozone is also generated in a very small quantity. Also, when the AC charging is effected in order to achieve the uniform charging, the ozone may increase more in quantity, the electric field of the AC voltage causes vibration or noise of the charging member and photosensitive member, or the surface of the photosensitive member may seriously deteriorate due to discharging, bringing about additional problems.

Under such circumstances, as a more effective charging method, Japanese Patent Application Laid-Open No. 6-003921 discloses a method in which a charge injection layer is provided on the surface of a photosensitive member and charges are directly injected into that layer by means of a contact charging member (which is called injection charging).

In the injection charging, the charging member can be brought into contact with the photosensitive member at a greater nip between them, and it is effective to use as the charging member a magnetic brush roller which can be brought into uniform contact with the surface of the photosensitive member and can be free from microscopic incomplete charging. This is to use a charging member having the form of a magnetic brush formed by magnetically confining, using a magnet roll, ferrite particles or charging magnetic particles obtained by dispersing magnetic fine particles in a resin.

The charge injection layer serving as a surface layer of the photosensitive member may be a layer formed by dispersing conductive fine particles in an insulating and light-transmitting binder. Such a layer is preferably used. The charging magnetic brush to which a voltage is applied comes in touch with this charge injection layer, whereupon the conductive fine particles come to exist as if they are numberless independent floating electrodes with respect to the conductive support of the photosensitive member, and an be expected to have such an action that they charge he capacitor formed by these floating electrodes.

Thus, the DC voltage applied to the contact charging member without utilizing any discharge phenomenon and the surface potential of the photosensitive member are converged into values substantially equal to each other, so that a low-voltage charging method can be accomplished.

However, as to magnetic particles comprised of only iron powder, ferrite or magnetite which are conventionally used as charging magnetic particles, it is very difficult to uniformly produce those having small particle diameters.

Meanwhile, magnetic particles obtained by dispersing magnetic fine particles in a binder resin can also be used as the charging magnetic particles. However, they have tended to be broken during running if a thermoplastic resin is used as the binder resin, and the fragments of broken particles may become buried in the photosensitive member surface to tend to block exposure or affect charging performance. Accordingly, it has been attempted to use a thermosetting resin as the binder resin. Since, however, magnetic particles produced by a conventional kneading and pulverization process can not be made sufficiently spherical, such particles can not be uniformly charged and may scratch the surface of the photosensitive member in some cases. In particular, in the case of charging, different from development, there is little toner present between the magnetic particles and the photosensitive member, and hence the problem of scratch and scrape of the photosensitive member may remarkably occur.

In the injection charging, the charging member must come well into contact with the photosensitive member before the charges can be injected. However, for the magnetic resin particles produced by pulverization, it has been difficult to come well into contact with the surface of the photosensitive member, tending to result in an insufficient charging uniformity.

In addition, if magnetic particles with a broad particle size distribution are used as the charging magnetic particles, uniform charging may become impossible to cause fog on images, especially when the process speed is high or when the photosensitive member has a high surface resistance.

SUMMARY OF THE INVENTION

An object of the present invention is to provide a charging apparatus and an electrophotographic apparatus that can prevent the object member from undergoing damage such as contamination, scratches and scrape, and also can achieve a superior charging uniformity and a superior image reproducibility.

The present invention provides a charging apparatus comprising an object member and a charging member; the charging member comprising a magnetic brush comprised of magnetic particles which is provided in contact with the object member and is capable of electrostatically charging the object member upon application of a voltage, wherein;

the magnetic particles comprise a composite containing a metal oxide and a thermosetting resin., the metal oxide being contained in an amount of from 80% by weight to 98% by weight based on the weight of the composite, and the thermosetting resin having been carbonized in part, and;

the magnetic particles contain magnetic particles having a particle diameter ½ times or less the number-average particle diameter of the magnetic particles, in an amount of 30% by number or less.

The present invention also provides an electrophotographic apparatus comprising an electrophotographic photosensitive member, a charging member, an exposure means, a developing means and a transfer means; the charging member comprising a magnetic brush comprised of magnetic particles which is provided in contact with the electrophotographic photosensitive member and is capable of electrostatically charging the electrophotographic photosensitive member upon application of a voltage, wherein;

the magnetic particles comprise a composite containing a metal oxide and a thermosetting resin; the metal oxide being contained in an amount of from 80% by weight to 98% by weight based on the weight of the composite, and the thermosetting resin having been carbonized in part, and;

the magnetic particles contain magnetic particles having a particle diameter ½ times or less the number-average particle diameter of the magnetic particles, in an amount of 30% by number or less.

DESCRIPTION OF THE PREFERRED EMBODIMENTS

Figure 1:
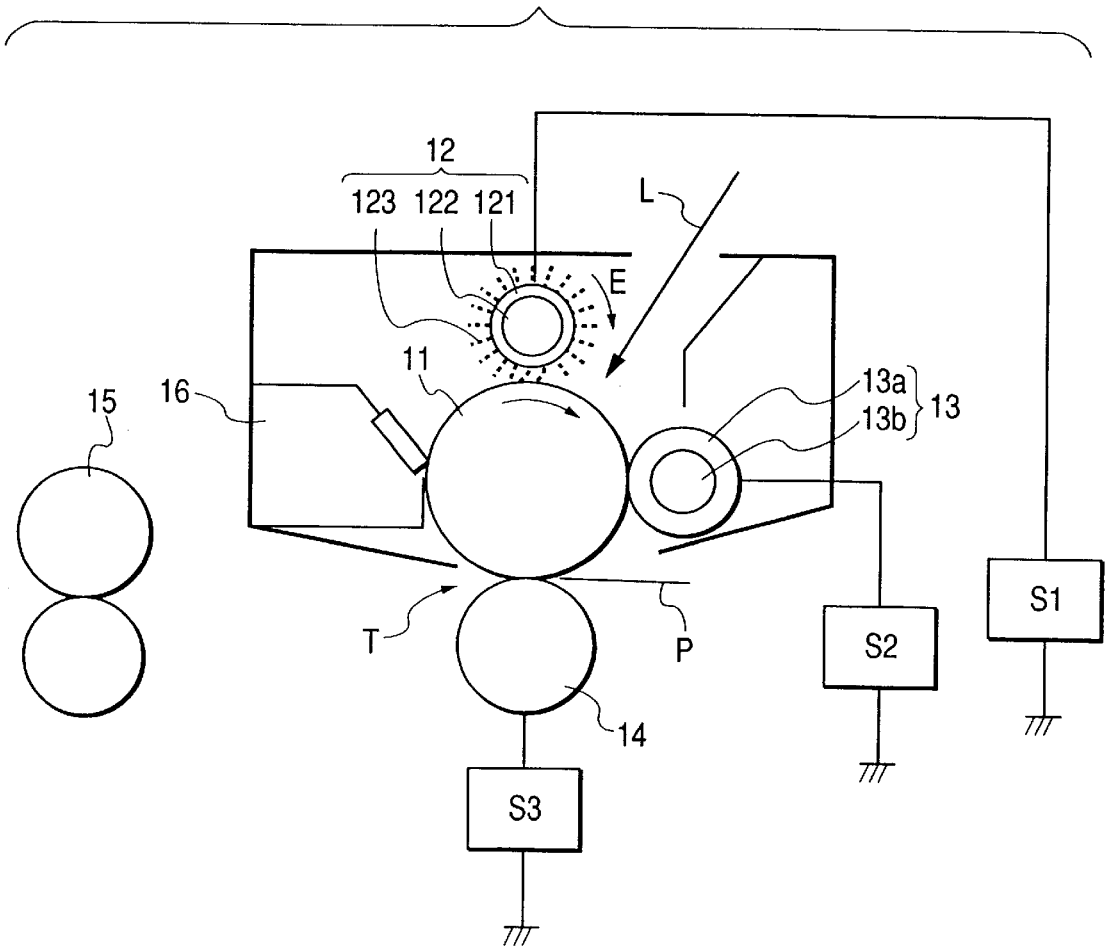
FIG. 1 illustrates an example of the constitution of an electrophotographic apparatus having the charging apparatus of the present invention.

The charging apparatus of the present invention has an object member (a member to be charged) and a charging member. The charging member comprises a magnetic brush comprised of magnetic particles which is provided in contact with the object member and is capable of electrostatically charging the object member upon application of a voltage.

The magnetic particles comprise a composite containing a metal oxide and a thermosetting resin; the metal oxide being contained in an amount of from 80% by weight to 98% by weight based on the weight of the composite, and the thermosetting resin having been carbonized in part; and the magnetic particles contain magnetic particles having a particle diameter ½ times or less the number-average particle diameter of the magnetic particles, in an amount of 30% by number or less.

The present invention is also an electrophotographic apparatus comprising an electrophotographic photosensitive member, the above charging member, an exposure means, a developing means and a transfer means.

As the metal oxide constituting the magnetic particles of the present invention, magnetite and ferrite represented by the general formula: $MO.Fe_2O_3$ or $MFe_2O_4$, showing magnetic properties, may preferably be used. Here, M represents a divalent or monovalent metal ion, i.e., Mn, Fe, Ni, Co, Cu, Mg, Zn, Cd or Li, and M may be a single metal or a plurality of metals. For example, it may include iron oxides such as magnetite, $\gamma$-$Fe_2O_3$, Mn-Zn ferrite, Ni-Zn ferrite, Mn-Mg ferrite, Ca-Mg ferrite, Li ferrite and Cu-Zn ferrite.

The magnetic particles used in the present invention may contain, together with the magnetic oxide, a non-magnetic metal oxide as shown below, whereby the magnetic force can be controlled within a preferable range.

Such a non-magnetic metal oxide may include metal oxides of metals such as Mg, Al, Si, Ca, Sc, Ti, V, Cr, Mn, Fe, Co, Ni, Cu, Zn, Sr, Y, Zr, Nb, Mo, Cd, Sn, Ba and Pb which are used alone or in combination. For example, $Al_2O_3$, $SiO_2$, CaO, $TiO_2$, $V_2O_5$, $CrO_2$, $MnO_2$, $\alpha$-$Fe_2O_3$, CoO, NiO, CuO, ZnO, SrO, $Y_2O_3$ and $ZrO_2$ may be used.

In such an instance, in order to improve adhesion to the binder resin thermosetting resin and improve carrier strength, it is more preferable to use particles having similar specific gravity and shape. For example, combinations of magnetite with hematite, magnetite with $SiO_2$, magnetite with $Al_2O_3$, magnetite with $TiO_2$, magnetite with Ca-Mn ferrite and magnetite with Ca-Mg ferrite may preferably be used. In particular, a combination of magnetite with hematite is preferred in view of cost and strength of magnetic particles.

The metal oxide may be provided with a conductivity. As a method therefor, for example, lattice defects may be formed by doping.

The above metal oxide may preferably have a number-average particle diameter of from 0.02 to 5 $\mu$m, which may vary depending on carrier particle diameter.

The metal oxide may preferably be treated to make lipophilic. A metal oxide having been made lipophilic can be incorporated in the binder resin uniformly and in a high density when dispersed in the binder resin to form the magnetic particles. Especially when the magnetic particles are formed by polymerization, such metal oxide is important to obtain spherical and surface-smooth particles and also to make particle size distribution sharp.

The treatment for making lipophilic may be made by a method in which the metal oxide is treated with a coupling agent such as a silane coupling agent or a titanate coupling agent or a method in which the metal oxide is dispersed in an aqueous medium containing a surface-active agent, to make its particle surfaces lipophilic.

As the silane coupling agent herein referred to, those having a hydrophobic group, an amino group or an epoxy group may be used. The silane coupling agent having a hydrophobic group may include, e.g., vinyltrichlorosilane, vinyltriethoxysilane and vinyltris(β-methoxy)silane. The silane coupling agent having an amino group may include γ-aminopropylethoxysilane, N-β(aminoethyl)-γ-aminopropyltrimethoxysilane, N-β(aminoethyl)-γ-aminopropylmethyldimethoxysilane and N-phenyl-γ-aminopropyltrimethoxysilane. The silane coupling agent having an epoxy group may include γ-glycidoxypropylmethyldiethoxysilane, γ-glycidoxypropyltriethoxysilane and β-(3,4-epoxycyclohexyl)trimethoxysilane.

The titanate coupling agent may include, e.g., isopropyltruisostearoyl titanate, isopropyltridodecylbenzenesulfonyl titanate and isopropyltris(dioctyl pyrophosphate) titanate.

As the surface-active agent, commercially available surface-active agents may be used as they are.

The magnetic particles used in the present invention can be obtained by mixing monomers and the metal oxide, directly polymerizing the resultant mixture to produce magnetic particles comprising a thermosetting resin having the metal oxide dispersed therein, and thereafter carbonizing the thermosetting resin in part. Then, this thermosetting resin is used as a binder resin, thus spherical particles with a strength high enough not to break during running can be produced.

The monomers used in the polymerization may include bisphenols and epichlorohydrin which serve as starting materials of epoxy resins, phenols and aldehydes which serve as starting materials of phenol resins, urea and aldehydes which serve as starting materials of urea resins, and melamine and aldehydes, any of which may be used. In the present invention, phenol resins are preferred in view of strength.

For example, as a method for producing the magnetic particles by using a curable phenol resin, a phenol and an aldehyde in an aqueous medium may be polymerized in the presence of a basic catalyst and with addition of the metal oxide, preferably the metal oxide having been treated to make lipophilic in order to obtain particles having a high sphericity and a sharp particle size distribution, to obtain the magnetic particles.

After the magnetic particles are formed by polymerization or after they are carbonized, the particles may optionally be classified to control the particle size distribution of the magnetic particles within the range of the present invention.

As a particularly preferred method for producing the magnetic particles of the present invention, the binder resin may preferably be used in a cross-linked state so that the magnetic particles can be improved in strength. For example, at the time of direct polymerization a cross-linkable resin may be selected to effect direct polymerization and cross-linking to obtain magnetic particles, or monomers containing a cross-linking component may be used.

The metal oxide is contained in the magnetic particles in an amount of from 80 to 98% by weight. If it is contained in an amount less than 80% by weight, granulating particles may agglomerate one another when the magnetic particles are produced by direct polymerization, tending to cause non-uniformity in particle size distribution, so that no good charging performance may be achieved. If it is in an amount more than 98% by weight, the magnetic particles may have a low strength to tend to cause the problems of, e.g., the break of magnetic particles as a result of running.

In the present invention, the magnetic particles containing the metal oxide in an amount of from 80 to 98% by weight also make it possible to form spherical magnetic particles and also to obtain magnetic particles having fine irregularities (hill and dales) on their surfaces. Because of the presence of such fine irregularities on their surfaces, the deterioration during running may occur at the dales and the hills are always stably present as injection points.

As stated above, the magnetic particles of the present invention have a high sphericity. In the present invention, the magnetic particles may preferably have a sphericity of 2 or less. If their sphericity is more than 2, the magnetic particles may have a poor fluidity and can not smoothly come into contact with the photosensitive member to make it difficult to obtain uniform charging. To measure the sphericity of the magnetic particles used in the present invention, at least 300 magnetic particles are sampled at random using a field-emission scanning electron microscope S-800, manufactured by Hitachi Ltd., and their sphericity calculated from the following expression is determined by means of an image processing analyzer LUZEX 3, manufactured by Nireco Co.

$$\text{Sphericity SF1}=(\text{MX LNG})^2/\text{AREA}\times\pi/4$$

MX LNG: maximum diameter of a magnetic particle

AREA: projected area of a magnetic particle Here, it means that, the closer to 1 the SF1 is, the more spherical the particle is.

In the present invention, the magnetic particles may preferably have a volume resistivity of from $1\times10^5$ to $1\times10^8$ Ω·cm. Those having a volume resistivity lower than $1\times10^5$ Ω·cm may cause a drop of charging voltage because of concentration of electric currents to defects such as pinholes if the photosensitive member has such defects, to cause faulty charging in the form of charging nips. On the other hand, those having a volume resistivity higher than $1\times10^8$ Ω·cm may make it hard for electric charges to be uniformly injected into the photosensitive member, to tend to cause fogged images due to minute faulty charging.

However, even when the magnetic particles of metal-oxide-dispersed resin as described above has a volume resistivity within the range of from $1\times10^5$ to $1\times10^8$ Ω·cm, the sites through which electric charges are injected may be lost to become achievable of no good charging when the particle surfaces are covered with a high-resistance resin and any fine metal oxide particles with a low resistance do not stand exposed to the surfaces in a large quantity. Accordingly, in the present invention, the thermosetting resin at the surface portions of particles is carbonized so as to be made into conductive carbon. This has made it possible to accelerate the injection of electric charges from the surfaces of the magnetic particles to effect more uniform charging. Thus, in the present invention, the thermosetting resin itself is carbonized, and hence the magnetic particles can be made to have a more uniform conductivity than magnetic particles further provided with conductive layers on their surfaces, and also can be free from separation of such layers during running.

The conductive carbon may preferably be in a content of from 1 to 15% by weight based on the total weight of the magnetic particles, and the magnetic particles may preferably have a volume resistivity of from $1\times10^5$ to $1\times10^8$ Ω·cm as a result of carbonization. If the conductive carbon is in a content less than 1% by weight, the effect of accelerating the charge injection stated above may be obtained with difficulty and uniform charging may not be performed. If it is in a content more than 15% by weight, the magnetic particles tend to have a low strength to cause break of particles during running in some cases.

The carbonization is carried out by heating the above magnetic particles of metal-oxide-dispersed resin in an inert atmosphere preferably at a temperature of from 350 to 450° C. for a stated time. At a temperature lower than 350° C., it is difficult to sufficiently carry out the carbonization. At a temperature higher than 450° C., the magnetic particles may change in magnetic properties to have a small magnetic force, or the carbonization may proceed too fast to control the content of the conductive carbon with ease. How to measure the content of conductive carbon in the magnetic particles will be described later.

Incidentally, as the magnetic particles have a smaller particle diameter, they come into closer contact with the photosensitive member, and hence it becomes possible to effect uniform charging. Since, however, the individual magnetic particles come to have a smaller magnetic force as the magnetic particles have a smaller particle diameter, the magnetic particles tend to adhere to the photosensitive member. It has been also found that magnetic particles on the surfaces of which electric charges can smoothly migrate as in the magnetic particles used in the present invention especially tend to adhere to the magnetic particles when an AC charging system is used in which a voltage formed by superimposing an AC component is applied to the contact charging member. It has been still also found that magnetic particles having a broad particle size distribution and containing particles with a small particle diameter in a large quantity make poor the uniformity of injection charging, and in addition such small particles especially tend to adhere to the photosensitive member.

Now, in the present invention, magnetic particles are used which have such a particle size distribution that magnetic particles having a particle diameter ½ times or less the number-average particle diameter of the all magnetic particles are contained in an amount of 30% by number or less based on the number of the all magnetic particles. This has made it possible to solve the above problems. The use of magnetic particles having such a sharp particle size distribution has also made it possible to achieve a good charging uniformity at the same time. The proportion (amount) of such particles is a cumulative value of the distribution of particles having a particle diameter ½ times or less the number-average particle diameter when number-based particle size distribution is measured by a method described later.

In the present invention, the magnetic particles having a particle diameter ½ times or less the number-average particle diameter may preferably have a distribution cumulative value of 20% by number or less, and particularly preferably 10% or less.

The magnetic particles used in the present invention may preferably have a number-average particle diameter in the range of from 1 to 100 $\mu$m, and particularly preferably in the range of from 1 to 50 $\mu$m from the viewpoint of charging uniformity. Magnetic particles having a number-average particle diameter larger than 100 $\mu$m are not preferable from the viewpoint of charging uniformity because the magnetic brush tends to rub the photosensitive member in such a small specific area that no sufficient charging may be effected, and also the magnetic brush tends to cause non-uniform sweep marks. On the other hand, those having a number-average particle diameter smaller than 1 $\mu$m may make individual magnetic particles have so small a magnetic force that the magnetic particles tend to adhere to the photosensitive member.

The magnetic particles of the present invention may preferably have a magnetic force of from 100 to 250 emu/cm$^3$ at 1 kilooersted. If they have a magnetic force smaller than 100 emu/cm$^3$, the confining force acting from the magnetic particle support (sleeve) tends to become short, so that the magnetic particles tend to adhere to the magnetic particles. If the magnetic particles have a magnetic force greater than 250 emu/cm$^3$, the magnetic brush tends to have loose and stiff ears, making it difficult to achieve uniform charging performance.

The parameters of the magnetic particles in the present invention are measured in the manner as described below.

The particle diameter of the magnetic particles used in the present invention is measured in the manner as described below. To measure the particle diameter of the magnetic particles, at least 300 magnetic particles having particle diameters of 0.1 $\mu$m or larger, photographed at 3,000 magnifications using a scanning electron microscope S-4500, manufactured by Hitachi Ltd., are sampled at random, and their horizontal-direction Feret's diameters are measured as particle diameters by means of an image processing analyzer LUZEX 3, manufactured by Nireco Co., to calculate the number average particle diameter. Also, the cumulative value of distribution of the magnetic particles having a particle diameter ½ times or less the number-average particle diameter is calculated from number-based particle size distribution.

The particle diameter of fine particles of the metal oxide used in the present invention is measured in the manner as described below. To measure the number-average particle diameter of the fine metal oxide particles, at least 300 particles are sampled at random on a photographic image enlarged at 10,000 to 50,000 magnifications using a transmission electron microscope H-800, manufactured by Hitachi Ltd., and horizontal-direction Feret's diameters of particles having particle diameters of 0.1 $\mu$m or larger are measured as particle diameters of the fine metal oxide particles by means of an image processing analyzer LUZEX 3, manufactured by Nireco Co., followed by averaging to calculate the number average particle diameter.

The magnetic characteristics of the magnetic particles used in the present invention are measured with a vibration magnetic field type magnetic characteristics automatic recorder BHV-30, manufactured by Riken Denshi K.K. Values of magnetic characteristics of the magnetic particles are indicated as the intensity of magnetization determined when an external magnetic field of 1 kilooersted is formed. A cylindrical plastic container is well densely packed with the magnetic particles. In this state, the magnetization moment is measured, and the actual weight of the container holding the sample is measured to determine its magnetization intensity. Next, the true density of the magnetic particles is measured using a dry automatic densitometer ACUPIC 1330 (manufactured by Shimadzu Corporation), and the true density is multiplied by the magnetization intensity (emu/g) to determine the intensity per unit volume (emu/cm$^3$).

Figure 2:
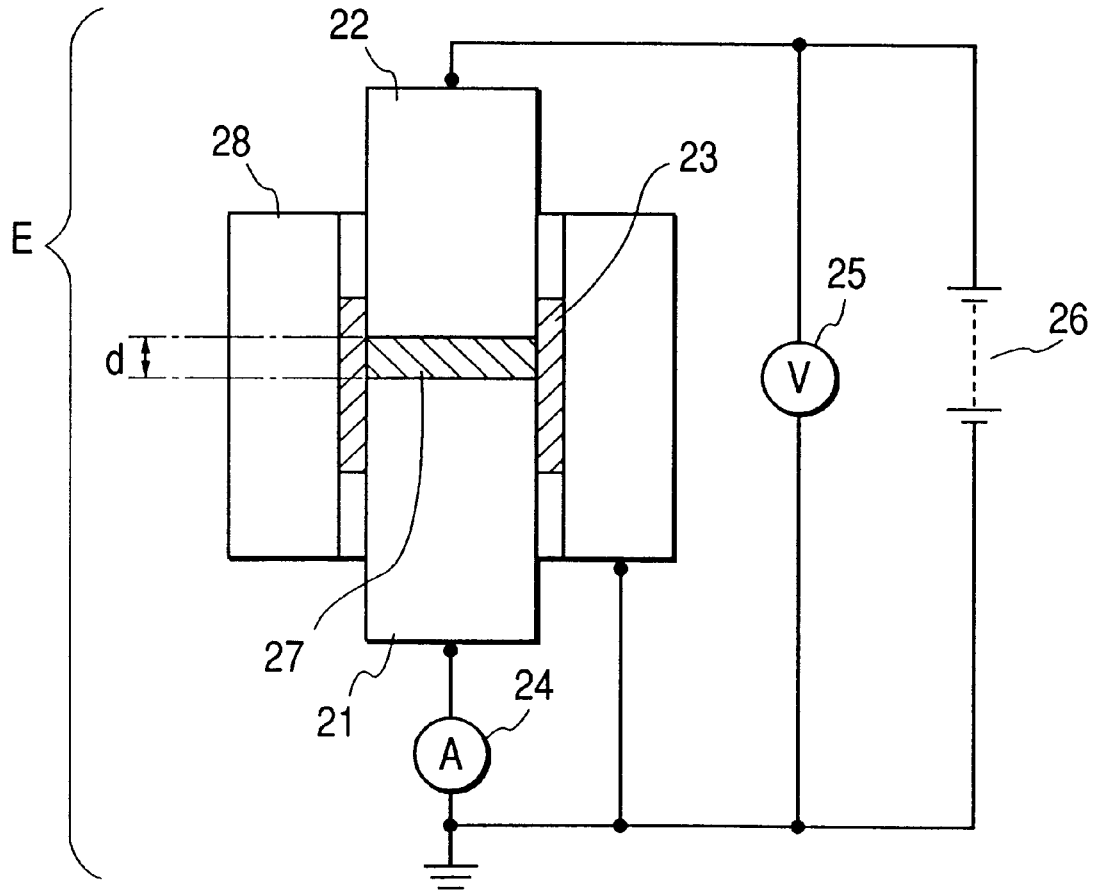
FIG. 2 cross-sectionally illustrates an apparatus for measuring the resistance of magnetic particles.

Resistivity characteristics of the magnetic particles used in the present invention are measured using a measuring apparatus shown in FIG. 2. A method is used in which cell E is packed with magnetic particles and electrodes 21 and 22 are so provided as to come into contact with the packed carrier particles,, where a voltage is applied across the electrodes and electric currents flowing at that time are measured to determine resistivity. In this measuring method, the magnetic particles, which are powdery, may cause a change in packing rate, which may be accompanied with a change in resistivity, and attention must be paid. The measurement of resistivity in the present invention is made under conditions of contact area S between the packed carrier particles and the cell: about 2.3 $cm^2$; thickness d: about 2 mm; load of the upper electrode 22: 180 g; and applied voltage: 100 V. In FIG. 2, reference numeral 23 denotes an insulating material; 24, an ammeter; 25, a voltmeter; 26, a voltage stabilizer; 27, the sample; and 28, a guide ring.

The content of conductive carbon in the magnetic particles used in the present invention is measured by a method describe below. Using a thermogravimetric analyzer TAC7, manufactured by Perkin-Elmer Corporation, the amount of resin in particles for each of the magnetic particles before carbonization and the magnetic particles after carbonization is calculated, and the content of carbon in the magnetic particles after carbonization is calculated from the difference between them.

The object member used in the present invention may preferably be an electrophotographic photosensitive member. There are no particular limitations on the electrophotographic photosensitive member, except that it must have a charge injection layer as a surface layer when the injection charging is carried out.

The charge injection layer may preferably have a volume resistivity of from $1\times10^9$ to $1\times10^{14}$ Ω·cm. The volume resistivity of the charge injection layer can be measured by a method in which a charge injection layer is formed on a polyethylene terephthalate (PET) film on the surface of which platinum has been vacuum-deposited and a DC voltage of 100 V is applied in an environment of 23° C. and 65% RH to measure its resistance by means of a volume resistance measuring device (4140B pAMATER, manufactured by Hulett Packard Co.).

The charge injection layer may be either a resin layer containing conductive particles such as conductive metal oxide particles or an inorganic layer such as a layer composed of SiC or the like.

The lifetime of the photosensitive member can be prolonged to a certain extent when the charge injection layer is formed in a larger thickness. However, when the charge injection layer is formed in a larger thickness, the charge injection layer formed may act as an electrical resistance layer or a scattering layer to tend to cause a deterioration of photoconductive characteristics of the photosensitive drum or an image deterioration due to scattering of imagewise exposure light. Accordingly, the charge injection layer may preferably be formed in a thickness of from 0.1 to 5 μm.

The injection charging is a method in which electric charges are directly injected into the surface of the photosensitive member by means of a contact charging member substantially without relying on the phenomenon of discharging. Hence, even when the voltage applied to the charging member is a voltage applied at a value lower than the discharge threshold value, the photosensitive member can be charged to have a potential corresponding to the applied voltage. However, what is important is that the charging does not predominantly take place relying on the phenomenon of discharging, and the use of a voltage formed by superimposing an AC voltage on a DC voltage is by no means excluded.

There are also no particular limitations on the exposure means, developing means and transfer means.

EXAMPLES

The present invention will be specifically described below by giving Examples. The present invention is by no means limited to these.

Production of Magnetic Particles

Magnetic Particles 1

To a magnetite having a number-average particle diameter of 0.24 μm, 0.5% by weight of a silane coupling agent 3-(2-aminoethylaminopropyl)dimethoxysilane was added, followed by mixing and agitation at a high speed in a container at 100° C. or above to make the magnetite lipophilic.

| | (by weight) |
|---|---|
| Phenol | 10 parts |
| Formaldehyde solution (40% of formaldehyde, 10% of methanol and 50% of water) | 6 parts |
| The above magnetite made lipophilic | 100 parts |

The above materials, 28% ammonia water as a basic catalyst and also water were put into a flask, and temperature was raised to 85° C. in 40 minutes while stirring and mixing them. Keeping that temperature, the reaction and hardening were carried out for 3 hours to effect first-stage polymerization. Thereafter, the reaction mixture was cooled to 30° C., and 130 parts by weight of water was added thereto. Thereafter, the supernatant formed was removed, and the precipitate also formed was washed with water, followed by air drying. Subsequently, this was further dried at 180° C. under reduced pressure (5 mmHg or below) to obtain magnetic particles.

The magnetic particles thus obtained were put into a rotary electric furnace, and its inside was displaced with nitrogen, in the state of which the temperature was raised to 380° C. in a stream of nitrogen to make treatment for 30 minutes, followed by cooling to room temperature, where the contents were taken out to obtain carbonized magnetic particles.

The magnetic particles thus obtained were classified by means of a multi-division classifier, stated specifically, Elbow Jet Labo EJ-L-3 (manufactured by Nittetsu Kogyo K. K.), to obtain magnetic particles 1, having a number-average particle diameter of 15.2 μm and whose accumulated value of the distribution of magnetic particles having a particle diameter ½ times or less the number-average particle diameter of the magnetic particles was 0.0% by number. The conductive carbon of the magnetic particles obtained was in a content of 3.2% by weight. Their SF-1 was 1.1, volume resistivity was $3\times10^7$ Ω·cm, and magnetic force was 220 emu/$cm^3$.

Magnetic Particles 2

The lipophilic treatment was made in the same manner as in Magnetic Particles 1 except that the magnetite was replaced with a ferrite having a number-average particle diameter of 0.23 μm.

| | (by weight) |
|---|---|
| Phenol | 8 parts |
| Formaldehyde solution (40% of formaldehyde, 10% of methanol and 50% of water) | 5 parts |
| The above ferrite made lipophilic | 100 parts |

Using the above materials, polymerization was carried out in the same manner as the magnetic particles 1 to obtain magnetic particles.

The magnetic particles thus obtained were put into a rotary electric furnace, and its inside was displaced with nitrogen, in the state of which the temperature was raised to 380° C. in a stream of nitrogen to make treatment for 40 minutes, followed by cooling to room temperature, where the contents were taken out to obtain carbonized magnetic particles.

The magnetic particles thus obtained were classified by means of the multi-division classifier to obtain magnetic particles 2, having a number-average particle diameter of 16.3 μm and whose accumulated value of the distribution of magnetic particles having a particle diameter ½ times or less the number-average particle diameter of the magnetic particles was 0.0% by number. The conductive carbon of the magnetic particles obtained was in a content of 5.1% by weight. Their SF-l was 1.2, volume resistivity was $8\times10^6$ Ω·cm, and magnetic force was 218 emu/cm$^3$.

Magnetic Particles 3

To each of a ferrite having a number-average particle diameter of 0.23 μm and α-$Fe_2O_3$ having a number-average particle diameter of 0.26 μm, a titanate coupling agent isopropyltriisostearoyl titanate was added in an amount of 0.6% by weight based on the weight of each metal oxide, followed by mixing and agitation under conditions of 100° C. and 0.5 hour to make them lipophilic.

| | (by weight) |
|---|---|
| Phenol | 8 parts |
| Formaldehyde solution (40% of formaldehyde, 10% of methanol and 50% of water) | 5 parts |
| The above ferrite made lipophilic | 55 parts |
| The above α-$Fe_2O_3$ made lipophilic | 45 parts |

Using the above materials, polymerization was carried out in the same manner as the magnetic particles 1 to obtain magnetic particles.

The magnetic particles thus obtained were put into a rotary electric furnace, and its inside was displaced with nitrogen, in the state of which the temperature was raised to 380° C. in a stream of nitrogen to make treatment for 40 minutes, followed by cooling to room temperature, where the contents were taken out to obtain carbonized magnetic particles.

The magnetic particles thus obtained were classified by means of the multi-division classifier to obtain magnetic particles 3, having a number-average particle diameter of 51.2 μm and whose accumulated value of the distribution of magnetic particles having a particle diameter ½ times or less the number-average. particle diameter of the magnetic particles was 9.5% by number. The conductive carbon of the magnetic particles obtained was in a content of 3.6% by weight. Their SF-1 was 1.1, volume resistivity was $8\times10^7$ Ω·cm, and magnetic force was 110 emu/cm$^3$.

Magnetic Particles 4

The magnetic particles having not been carbonized in Magnetic Particles 3 were put into a rotary electric furnace, and its inside was displaced with nitrogen, in the sate of which the temperature was raised to 380° C. in a stream of nitrogen to make treatment for 70 minutes, followed by cooling to room temperature, where the contents were taken out to obtain carbonized magnetic particles.

The magnetic particles thus obtained were classified by means of the multi-division classifier to obtain magnetic particles 4, having a number-average particle diameter of 52.3 μm and whose accumulated value of the distribution of magnetic particles having a particle diameter ½ times or less the number-average particle diameter of the magnetic particles was 11.0% by number. The conductive carbon of the magnetic particles obtained was in a content of 7.4% by weight. Their SF-1 was 1.1, volume resistivity was $5\times10^7$ Ω·cm, and magnetic force was 108 emu/cm$^3$.

| Magnetic Particles 5 | (by weight) |
|---|---|
| Phenol | 10 parts |
| Formaldehyde solution (40% of formaldehyde, 10% of methanol and 50% of water) | 6 parts |
| Magnetite made lipophilic (the same one as used to produce the magnetic particles 1) | 100 parts |

The above materials, 28% ammonia water as a basic catalyst and also water were put into a flask, and temperature was raised to 85° C. in 40 minutes while stirring and mixing them. Keeping that temperature, the reaction and curing was carried out for 3 hours to effect first-stage polymerization. Thereafter, the reaction mixture was cooled to 30° C., and 130 parts by weight of water was added thereto. Thereafter, the supernatant formed was removed, and the precipitate also formed was washed with water, followed by air drying. Subsequently, this was further dried at 180° C. under reduced pressure (5 mmHg or below) to obtain magnetic particles.

The magnetic particles thus obtained were put into a rotary electric furnace, and its inside was displaced with nitrogen, in the state of which the temperature was raised to 380° C. in a stream of nitrogen to make treatment for 25 minutes, followed by cooling to room temperature, where the contents were taken out to obtain carbonized magnetic particles.

The magnetic particles thus obtained were classified by means of the multi-division classifier to obtain magnetic particles 5, having a number-average particle diameter of 40.0 μm and whose accumulated value of the distribution of magnetic particles having a particle diameter ½ times or less the number-average particle diameter of the magnetic particles was 8.5% by number. The conductive carbon of the magnetic particles obtained was in a content of 2.5% by weight. Their SF-1 was 1.2, volume resistivity was $8\times10^6$ Ω·cm, and magnetic force was 205 emu/cm$^3$.

| Magnetic Particles 6 | (by weight) |
|---|---|
| Phenol | 10 parts |
| Formaldehyde solution (40% of formaldehyde, 10% of methanol and 50% of water) | 6 parts |
| Ferrite made lipophilic (the same one as used to produce the magnetic particles 3) | 58 parts |
| α-$Fe_2O_3$ made lipophilic (the same one as used to produce the magnetic particles 3) | 42 parts |

Using the above materials, polymerization was carried out in the same manner as the magnetic particles 1 to obtain magnetic particles.

The magnetic particles thus obtained were put into a rotary electric furnace, and its inside was displaced with nitrogen, in the state of which the temperature was raised to 380° C. in a stream of nitrogen to make treatment for 40 minutes, followed by cooling to room temperature, where the contents were taken out to obtain carbonized magnetic particles.

The magnetic particles thus obtained were classified by means of the multi-division classifier to obtain magnetic particles 6, having a number-average particle diameter of 39.5 μm and whose accumulated value of the distribution of magnetic particles having a particle diameter ½ times or less the number-average particle diameter of the magnetic particles was 18.1% by number. The conductive carbon of the magnetic particles obtained was in a content of 3.6% by weight;. Their SF-1 was 1.1, volume resistivity was $7\times10^7$ Ω·cm, and magnetic force was 120 emu/cm$^3$.

Magnetic Particles 7

The magnetic particles having not been carbonized in Magnetic Particles 1 were used as magnetic particles 7 as they were.

The magnetic particles 7 had a number-average particle diameter of 15.2 μm and its accumulated value of the distribution of magnetic particles having a particle diameter ½ times or less the number-average particle diameter of the magnetic particles was 0.0% by number. Their SF-1 was 1.1, volume resistivity was $5\times10^8$ Ω·cm, and magnetic force was 224 emu/cm$^3$.

Magnetic Particles 8

To each of a magnetite having a number-average particle diameter of 0.25 μm and α-$Fe_2O_3$ having a number-average particle diameter of 0.26 μm, a silane coupling agent γ-aminopropylethoxysilane was added in an amount of 0.6% by weight based on the weight of each metal oxide, followed by mixing and agitation under conditions of 100° C. and 0.4 hour to make them lipophilic.

| | (by weight) |
|---|---|
| Phenol | 8 parts |
| Formaldehyde solution (40% of formaldehyde, 10% of methanol and 50% of water) | 5 parts |
| The above magnetite made lipophilic | 55 parts |
| The above α-$Fe_2O_3$ made lipophilic | 45 parts |

Using the above materials, polymerization was carried out in the same manner as the magnetic particles 1 to obtain magnetic particles.

The magnetic particles thus obtained were put into a rotary electric furnace, and its inside was displaced with nitrogen, in the state of which the temperature was raised to 380° C. in a stream of nitrogen to make treatment for 40 minutes, followed by cooling to room temperature, where the contents were taken out to obtain carbonized magnetic particles.

The magnetic particles thus obtained were classified by means of the multi-division classifier to obtain magnetic particles 8, having a number-average particle diameter of 53.5 μm and whose accumulated value of the distribution of magnetic particles having a particle diameter ½ times or less the number-average particle diameter of the magnetic particles was 22.0% by number. The conductive carbon of the magnetic particles obtained was in a content of 3.4% by weight: Their SF-1 was 1.1, volume resistivity was $9\times10^7$ Ω·cm, and magnetic force was 112 emu/cm$^3$.

| Magnetic Particles 9 | (by weight) |
|---|---|
| $Fe_2O_3$ | 50 parts |
| CuO | 27 parts |
| ZnO | 23 parts |

The above materials were mixed by means of a ball mill. The mixture obtained was calcined, and thereafter pulverized using the ball mill, further followed by granulation by means of a spray dryer. This was fired to obtain magnetic particles.

The magnetic particles thus obtained were classified twice repeatedly by means of the multi-division classifier to obtain magnetic particles 9, having a number-average particle diameter of 19.5 μm and whose accumulated value of the distribution of magnetic particles having a particle diameter ½ times or less the number-average particle diameter of the magnetic particles was 17.5% by number. Their SF-1 was 1.4, volume resistivity was $8\times10^6$ Ω·cm, and magnetic force was 279 emu/cm$^3$.

Magnetic Particles 10

The lipophilic treatment was made in the same manner as in Magnetic Particles 1 except that the magnetite was replaced with a ferrite having a number-average particle diameter of 0.23 μm.

| | (by weight) |
|---|---|
| Phenol | 9 parts |
| Formaldehyde solution (40% of formaldehyde, 10% of methanol and 50% of water) | 5 parts |
| The above ferrite made lipophilic | 100 parts |

Using the above materials, polymerization was carried out in the same manner as the magnetic particles 1 to obtain magnetic particles.

The magnetic particles thus obtained were put into a rotary electric furnace, and its inside was displaced with nitrogen, in the state of which the temperature was raised to 380° C. in a stream of nitrogen to make treatment for 35 minutes, followed by cooling to room temperature, where the contents were taken out to obtain carbonized magnetic particles, magnetic particles 10.

The magnetic particles 10 thus obtained had a number-average particle diameter of 16.0 μm and its accumulated value of the distribution of magnetic particles having a particle diameter ½ times or less the number-average particle diameter of the magnetic particles was 31.2% by number. The conductive carbon of the magnetic particles obtained was in a content of 3.4% by weight. Their SF-1 was 1.1, volume resistivity was $4\times10^7$ Ω·cm, and magnetic force was 210 emu/cm$^3$.

| Magnetic Particles 11 | (by weight) |
|---|---|
| Phenol | 0.9 part |
| Formaldehyde solution (40% of formaldehyde, 10% of methanol and 50% of water) | 0.5 part |
| Carbon black | 1 part |
| Toluene | 20 parts |

The above materials were mixed using a paint shaker. The dispersion thus obtained was mixed with 200 parts by weight of magnetic particles having not been carbonized. The solvent was evaporated while continuously applying shear stress, to obtain magnetic particles having carbon-dispersed phenol resin layers as surface layers.

The magnetic particles thus obtained were classified by means of the multi-division classifier to obtain magnetic particles 11, having a number-average particle diameter of 15.7 μm and whose accumulated value of the distribution of magnetic particles having a particle diameter ½ times or less the number-average particle diameter of the magnetic particles was 0.0% by number. The SF-1 of the magnetic particles obtained was 1.1, volume resistivity was $5\times10^7$ Ω·cm, and magnetic force was 216 emu/cm$^3$.

The above results are summarized in Table 1.

TABLE 1

| | Average particle diam. (μm) | Particles with ≦½ time diam. (%) | Conductive carbon content (wt. %) | SF-1 | Volume resistivity (Ω · cm) | Magnetic force (emu/cm$^3$) |
|---|---|---|---|---|---|---|
| Magnetic Particles: | | | | | | |
| 1 | 15.2 | 0.0 | 3.2 | 1.1 | $3\times10^7$ | 220 |
| 2 | 16.3 | 0.0 | 5.1 | 1.2 | $8\times10^6$ | 218 |
| 3 | 51.2 | 9.5 | 3.6 | 1.1 | $8\times10^7$ | 110 |
| 4 | 52.3 | 11.0 | 7.4 | 1.1 | $5\times10^7$ | 108 |
| 5 | 40.0 | 8.5 | 2.5 | 1.2 | $8\times10^6$ | 205 |
| 6 | 39.5 | 18.1 | 3.6 | 1.1 | $7\times10^7$ | 120 |
| 7 | 15.2 | 0.0 | — | 1.1 | $5\times10^8$ | 224 |
| 8 | 53.5 | 22.0 | 3.4 | 1.1 | $9\times10^7$ | 112 |
| 9 | 19.5 | 17.5 | — | 1.4 | $8\times10^6$ | 279 |
| 10 | 16.0 | 31.2 | 3.4 | 1.1 | $4\times10^7$ | 210 |
| 11 | 15.7 | 0.0 | — | 1.1 | $5\times10^7$ | 218 |

Electrophotographic Apparatus Used in Examples

FIG. 1 schematically illustrates the constitution of an electrophotographic apparatus having the charging apparatus of the present invention. The electrophotographic apparatus in the present Examples is a laser beam printer.

Reference numeral 11 denotes a drum type electrophotographic photosensitive member serving as the object member. This is hereinafter called a photosensitive drum. In the present Examples, the photosensitive drum is a photosensitive drum employing an organic photoconductive material (i.e., an OPC photosensitive drum), having a diameter of 30 mm, and is rotatingly driven in the clockwise direction as shown by an arrow D, at a given process speed (peripheral speed).

Reference numeral 12 denotes a charging means having a conductive magnetic brush as a contact charging member which is brought into touch with the photosensitive drum 11, and is constituted of magnetic particles 123 attracted to a rotatable non-magnetic charging sleeve 121 by the aid of a magnetic force of a magnet 122. The magnetic field of this charging sleeve 121 at the part adjacent to the photosensitive drum is 800 oersteds. To this magnetic brush, a DC charging bias of −700 V is applied from a charging bias applying power source S1. The gap between the charging sleeve 121 surface and the photosensitive drum 11 surface has a minimum value of 500 μm. The magnetic particles 123 on the charging sleeve 121 are coated in a thickness of 1 mm, and form a charging nip of about 4 mm wide between the charging sleeve 121 and the photosensitive drum 11. The magnetic brush formed by the magnetic particles 123 is transported as the charging sleeve is rotated in the direction of an arrow E in FIG. 1 (the counter direction with respect to the moving direction of the photosensitive drum surface in the charging zone), and the magnetic particles come into contact with the photosensitive drum surface one after another.

In the present Examples, the ratio of peripheral speed of the magnetic brush to that of the photosensitive drum was set at −150%.

The ratio of peripheral speed of the magnetic brush to that of the photosensitive drum is represented by the following expression.

$$\text{Peripheral speed ratio (\%)} = (\text{magnetic brush peripheral speed} - \text{photosensitive drum peripheral speed})/\text{photosensitive drum peripheral speed}\times 100$$

The peripheral speed of the magnetic brush is a negative value when it is rotated counter to the rotation of the photosensitive drum in the charging zone.

The photosensitive drum 11 having been electrostatically charged is subjected to scanning exposure L made by laser beams outputted from a laser beam scanner (not shown; having a laser diode, a polygon mirror and so forth) and intensity-modulated in accordance with time-sequential electrical digital pixel signals of the intended image information, so that an electrostatic latent image of 1,200 dpi corresponding to the intended image information is formed on the surface of the photosensitive drum 11. The electrostatic latent image is developed as a toner image by means of a reversal developing assembly 13 making use of a magnetic one-component insulating toner.

Reference numeral **13*a* denotes a non-magnetic developing sleeve of 16 mm in diameter, internally provided with a magnet 13*b*. The above toner (negative toner) is coated on this developing sleeve, which is then rotated at the same peripheral speed as that of the photosensitive drum 11 in the state that its distance to the surface of the photosensitive drum 11 is set at 300 μm, during which a developing bias is applied to the developing sleeve 13*a* from a developing bias power source S2. As the voltage applied, a voltage obtained by superposing on a DC voltage of −500 V a rectangular AC voltage having a frequency of 1,800 Hz and a peak-to-peak voltage of 1,600 V is applied to cause jumping development to take place between the developing sleeve 13*a* and the photosensitive drum 11**.

Meanwhile, a transfer medium P as a recording medium is fed from a paper feed section (not shown), and is guided at a stated timing into a pressure nip portion (transfer zone) T formed between the photosensitive drum 11 and a medium-resistance transfer roller 14 serving as a contact transfer means brought into contact with the former at a stated pressure. To the transfer roller 14, a stated transfer bias voltage is applied from a transfer bias applying power source S3. In the present Examples, a transfer roller having a roller resistance value of $5\times10^8$ ohms is used, and a DC voltage of +2,000 V is applied to transfer toner images.

The transfer medium P guided into the transfer zone T is sandwiched at, and transported through, the transfer portion T, and toner images formed and held on the surface of the photosensitive drum 11 are successively transferred by the aid of electrostatic force and pressure.

The transfer medium P on which the toner images have been transferred is separated from the surface of the photosensitive drum 11 and then led into a fixing assembly 15 of, e.g., a heat-fixing system, where the toner images are fixed, and the fixed images are outputted outside the apparatus as an image-formed product (a print or a copy).

After the toner images have been transferred to the transfer medium P, the surface of the photosensitive drum 11 is cleaned by means of a cleaning assembly 16 to remove contaminants adhering thereto such as residual toner, and is repeatedly used for subsequent image formation. In the present invention, the electrophotographic apparatus may be of what is called the cleanerless system, which has no independent cleaning means and collects the residual toner substantially by the developing means.

The photosensitive member used in the present Examples will be described below.

The photosensitive drum 11 is an OPC photosensitive member for negative charging, and comprises a drum type support of 30 mm in diameter, made of aluminum, and the following five, first to fifth functional layers provided thereon in order from the lower part.

The first layer is a subbing layer, which is a conductive layer of about 20 μm thick provided in order to level defects and the like of the aluminum drum and also in order to prevent moire from being caused by the reflection of laser exposure light.

The second layer is a positive-charge injection preventive layer, which is a medium-resistance layer of about 1 μm thick playing such a role that the positive charges injected from the aluminum support are prevented from cancelling the negative charges held on the photosensitive drum surface, and whose resistance is controlled to about $10^6$ Ω·cm by Amilan resin and methoxymethylated nylon.

The third layer is a charge generation layer, which is a layer of about 0.3 μm thick formed of a resin with a disazo pigment dispersed therein, and generates positive-negative charge pairs when exposed to laser light.

The fourth layer is a charge transport layer, which is formed of a polycarbonate resin with hydrazone dispersed therein, and is a p-type semiconductor layer. Hence, the negative charges held on the photosensitive drum surface can not move through this layer and oily the charges generated in the charge generation layer can be transported to the photosensitive drum surface.

The fifth layer is the charge injection layer, which is a coat layer formed of a material comprising a photocurable acrylic resin and dispersed therein ultrafine $SnO_2$ particles and a fluorine resin such as polytetrafluoroethylene (PTFE). Stated specifically, 60 parts by weight of a photocurable acrylic monomer, 60 parts by weight of ultrafine tin oxide particles doped with antimony to have a low resistance and having an average particle diameter of about 0.4 μm before dispersion, 50 parts by weight of fine polytetrafluoroethylene particles having an average particle diameter of 0.18 μm, 20 parts by weight of 2-methylthioxanthone as a photo-initiator and 400 part by weight of methanol were dispersed by means of a sand mill for 48 hours to obtain a coating fluid, which was coated by dipping in a thickness of 2 μm to form the charge injection layer. The charge injection layer had a volume resistivity of $1\times10^{13}$ Ω·cm.

EXAMPLE 1

Images were reproduced using the above electrophotographic apparatus, in which the magnetic particles 1 were used and the process speed was set at 300 mm/sec. As a result, an excellent dot reproducibility was exhibited, and the magnetic particles were found to have good charge injection properties. Also, the magnetic particles did not adhere to the photosensitive member surface. An image reproduction running test was also made on 10,000 sheets. As a result, good performances at the initial stage were maintained, and the magnetic particles did neither break to contaminate the photosensitive member surface nor scratch the photosensitive member surface by reason of particle shape.

The dot reproducibility and the adhesion-freeness of magnetic particles to photosensitive member were evaluated in the following manner.

(1) Dot reproducibility:

Dots formed on the photosensitive drum by developing halftone areas (latent-image spot diameter: 15 μm) of an image were entered in a personal computer as image date by means of a stereomicroscope provided with a CCD. Next, the pixel area of these dots was calculated, and this was computed on 100 dots to calculate average value a and standard deviation S. The value S/a, obtained by dividing the standard deviation S by the average value a of the dot pixel area was used as an evaluation value for the dot reproducibility to make evaluation according to the following criteria.

AA: Less than 0.05.

A: From 0.05 to less than 0.1.

B: From 0.1 to less than 0.15.

BC: From 0.15 to less than 0.2.

C: 0.2 or more.

(2) Adhesion-freeness of magnetic particles to photosensitive member:

A transparent adhesive tape was stuck to the photosensitive drum after image reproduction and thereafter peeled therefrom to count the number of magnetic particles having adhered within the area of 5 cm×5 cm of the photosensitive drum, and the number of adhering magnetic particles per 1 $cm^2$ was calculated to make evaluation according to the following criteria.

AA: Less than 0.1 particle/$cm^2$

A: From 0.1 to less than 0.5 particle/$cm^2$

B: From 0.5 to less than 1 particle/$cm^2$

BC: From 1 to less than 5 particles/$cm^2$

C: 5 or more particles/$cm^2$

EXAMPLE 2

Images were reproduced using the above electrophotographic apparatus, in which the magnetic particles 2 were used and the process speed was set at 350 mm/sec. As a result, good results were obtained like those in Example 1.

EXAMPLE 3

Images were reproduced using the above electrophotographic apparatus, in which the magnetic particles 3 were used and the process speed was set at 200 mm/sec. As a result, the dot reproducibility was; slightly inferior to that in Example 1 and the magnetic particles adhered to the photosensitive drum surface in a very small quantity.

EXAMPLE 4

Images were reproduced using the above electrophotographic apparatus, in which the magnetic particles 4 were used and the process speed was set at 200 mm/sec. As a result, the dot reproducibility was slightly inferior to that in Example 1 and the magnetic particles adhered to the photosensitive drum surface in a slightly larger quantity than those in Example 3.

EXAMPLE 5

Images were reproduced using the above electrophotographic apparatus, in which the magnetic particles 5 were used and the process speed was set at 150 mm/sec. As a result, good results were obtained like those in Example 1.

EXAMPLE 6

Images were reproduced using the above electrophotographic apparatus, in which the magnetic particles 6 were used and the process speed was set at 200 mm/sec. As a result, the dot reproducibility was more inferior to that in Example 4 and the magnetic particles adhered to the photosensitive drum surface in a slightly larger quantity than those in Example 3.

EXAMPLE 7

Images were reproduced under the same conditions as in Example 3 except for using the magnetic particles 8. As a result, the magnetic particles adhered to the. photosensitive drum surface and the dot reproducibility was inferior.

Comparative Example 1

Images were reproduced under the same conditions as in Example 1 except for using the magnetic particles 7. As a result, the photosensitive drum surface was not able to be uniformly charged and the dot reproducibility was poor.

Comparative Example 2

Images were reproduced under the same conditions as in Example 5 except for using the magnetic particles 9. As a result, a good dot reproducibility was seen at the initial stage and the magnetic particles having adhered to the photosensitive drum were in a small quantity. After image reproduction running on about 5,000 sheets, however, the photosensitive drum surface was scratched to adversely affect images.

Comparative Example 3

Images were reproduced under the same conditions as in Example 3 except for using the magnetic particles 10. As a result, the magnetic particles adhered to the photosensitive drum surface and the dot reproducibility was poor.

Comparative Example 4

Images were reproduced under the same conditions as in Example 3 except for using the magnetic particles 11. As a result, no magnetic particles adhered to the photosensitive drum surface, but the dot reproducibility was poor.

The results of the above Examples and Comparative Examples are shown in Table 2.

What is claimed is:

1. A charging apparatus comprising an object member and a charging member; said charging member comprising a magnetic brush comprised of magnetic particles which is provided in contact with the object member and is capable of electrostatically charging the object member upon application of a voltage, wherein;

said magnetic particles comprise a composite containing a metal oxide and a thermosetting resin; said metal oxide being contained in an amount of from 80% by weight to 98% by weight based on the weight of the composite, and said thermosetting resin having been carbonized in part, and;

said magnetic particles contain magnetic particles having a particle diameter ½ times or less a number-average particle diameter of the magnetic particles, in an amount of 30% or less by number.

2. The charging apparatus according to claim 1, wherein said magnetic particles having a particle diameter ½ times or less the number-average particle diameter or the magnetic particles are in an amount of 20% or less by number.

3. The charging apparatus according to claim 1 or 2, wherein said magnetic particles are obtained by directly polymerizing a mixture of a metal oxide and a monomer for a thermosetting resin.

4. The charging apparatus according to claim 3, wherein said magnetic particles have a number-average particle diameter of from 1 $\mu$m to 100 $\mu$m.

5. The charging apparatus according to claim 1 or 2, wherein said magnetic particles have a volume resistivity of from $1\times10^5$ Ω·cm to $1\times10^8$ Ω·cm.

6. The charging apparatus according to claim 4, wherein said magnetic particles have a volume resistivity of from $1\times10^5$ Ω·cm to $1\times10^8$ Ω·cm.

7. The charging apparatus according to claim 1 or 2, wherein said thermosetting resin is a phenol resin.

8. The charging apparatus according to claim 4, wherein said thermosetting resin is a phenol resin.

9. The charging apparatus according to claim 1 or 2, wherein said magnetic particles contains conductive carbon in an amount of from 1% by weight to 15% by weight based on the weight of the magnetic particles.

10. The charging apparatus according to claim 4, wherein said magnetic particles contains conductive carbon in an

TABLE 2

| | Magnetic particles | Process speed (mm/sec) | Dot reproducibility: Initial st. | Dot reproducibility: $5\times10^3$ sh. | Dot reproducibility: $1\times10^4$ sh. | Magnetic particle adhesion-freeness: Initial st. | Magnetic particle adhesion-freeness: $5\times10^3$ sh. | Magnetic particle adhesion-freeness: $1\times10^4$ sh. | Remarks |
|---|---|---|---|---|---|---|---|---|---|
| Example: | | | | | | | | | |
| 1 | 1 | 300 | AA | AA | AA | AA | AA | AA | |
| 2 | 2 | 350 | AA | AA | AA | AA | AA | AA | |
| 3 | 3 | 200 | A | A | A | A | A | B | |
| 4 | 4 | 200 | A | A | B | A | B | B | |
| 5 | 5 | 150 | AA | AA | AA | AA | AA | AA | |
| 6 | 6 | 200 | A | B | B | A | B | B | |
| 7 | 8 | 200 | A | B | B | B | B | B | |
| Comparative Example: | | | | | | | | | |
| 1 | 7 | 300 | A | B | BC | AA | AA | AA | |
| 2 | 9 | 150 | A | B | C | A | A | A | *1 |
| 3 | 10 | 200 | B | B | BC | A | B | C | |
| 4 | 11 | 200 | B | B | BC | AA | AA | AA | |

*1: Scrape of photosensitive drum surface on 5,000th sheets.

amount of from 1% by weight to 15% by weight based on the weight of the magnetic particles.

11. The charging apparatus according to claim 1 or 2, wherein said magnetic particles have a magnetic force of from 100 emu/cm$^3$ to 250 emu/cm$^3$.

12. The charging apparatus according to claim 4, wherein said magnetic particles have a magnetic force of from 100 emu/cm$^3$ to 250 emu/cm$^3$.

13. The charging apparatus according to claim 1 or 2, wherein said object member has a charge injection layer as a surface layer.

14. The charging apparatus according to claim 4, wherein said object member has a charge injection layer as a surface layer.

15. An electrophotographic apparatus comprising an electrophotographic photosensitive member, a charging member, an exposure means, a developing means and a transfer means; said charging member comprising a magnetic brush comprised of magnetic particles which is provided in contact with the electrophotographic photosensitive member and is capable of electrostatically charging the electrophotographic photosensitive member upon application of a voltage, wherein;

said magnetic particles comprise a composite containing a metal oxide and a thermosetting resin; said metal oxide being contained in an amount of from 80% by weight to 98% by weight based on the weight of the composite, and said thermosetting resin having been carbonized in part, and;

said magnetic particles contain magnetic particles having a particle diameter ½ times or less a number-average particle diameter or the magnetic particles, in an amount of 30% or less by number.

16. The electrophotographic apparatus according to claim 15, wherein said magnetic particles having a particle diameter or ½ times or less the number-average particle diameter of the magnetic particles are in an amount of 20% or less by number.

17. The electrophotographic apparatus according to claim 15 or 16, wherein said magnetic particles are obtained by directly polymerizing a mixture of a metal oxide and a monomer for a thermosetting resin.

18. The electrophotographic apparatus according to claim 17, wherein said magnetic particles have a number-average particle diameter of from 1 $\mu$m to 100 $\mu$m.

19. The electrophotographic apparatus according to claim 15 or 16, wherein said magnetic particles have a volume resistivity of from $1\times10^5$ Ω·cm to $1\times10^8$ Ω·cm.

20. The electrophotographic apparatus according to claim 18, wherein said magnetic particles have a volume resistivity of from $1\times10^5$ Ω·cm to $1\times10^8$ Ω·cm.

21. The electrophotographic apparatus according to claim 15 or 16, wherein said thermosetting resin is a phenol resin.

22. The electrophotographic apparatus according to claim 18, wherein said thermosetting resin is a phenol resin.

23. The electrophotographic apparatus according to claim 15 or 16, wherein said magnetic particles contains conductive carbon in an amount of from 1% by weight to 15% by weight based on the weight of the magnetic particles.

24. The electrophotographic apparatus according to claim 18, wherein said magnetic particles contains conductive carbon in an amount of from 1% by weight to 15% by weight based on the weight of the magnetic particles.

25. The electrophotographic apparatus according to claim 15 or 16, wherein said magnetic particles have a magnetic force of from 100 emu/cm$^3$ to 250 emu/cm$^3$.

26. The electrophotographic apparatus according to claim 18, wherein said magnetic particles have a magnetic force of from 100 emu/cm$^3$ to 250 emu/cm$^3$.

27. The electrophotographic apparatus according to claim 15 or 16, wherein said electrophotographic photosensitive member has a charge injection layer as a surface layer.

28. The electrophotographic apparatus according to claim 18, wherein said electrophotographic photosensitive member has a charge injection layer as surface layer.

* * * * *

UNITED STATES PATENT AND TRADEMARK OFFICE

CERTIFICATE OF CORRECTION

PATENT NO. : 6,038,419
DATED : March 14, 2000
INVENTOR(S) : Yuzo Tokunaga

It is certified that error appears in the above-identified patent and that said Letters Patent is hereby corrected as shown below:

Column 1,
Line 63, "AC.voltage" should read -- AC voltage --.

Column 2,
Line 38, "he" should read -- the --.

Column 4,
Line 20, "MO.$Fe_2o_3$" should read -- MO·$Fe_2O_3$ --.

Column 5,
Line 15, "ltruisostearoyl" should read -- ltriisostearoyl --.

Column 6,
Line 24, "Here", should be more to the next line.

Column 8,
Line 60 "particles,," should read -- particles, --.

Column 13,
Line 7, "weight;." should read -- weight. --.

UNITED STATES PATENT AND TRADEMARK OFFICE

CERTIFICATE OF CORRECTION

PATENT NO. : 6,038,419
DATED : March 14, 2000
INVENTOR(S) : Yuzo Tokunaga

It is certified that error appears in the above-identified patent and that said Letters Patent is hereby corrected as shown below:

Column 17,
Line 14, "moire" should read -- moiré --; and
Line 31, "oily" should read -- only --.

Column 18,
Line 45, "was; slightly" should read -- was slightly --.

Signed and Sealed this

Ninth Day of October, 2001

*Attest:*

Nicholas P. Godici

*Attesting Officer*

NICHOLAS P. GODICI
*Acting Director of the United States Patent and Trademark Office*